US005862924A

United States Patent [19]

Dumont

[11] Patent Number: 5,862,924

[45] Date of Patent: Jan. 26, 1999

[54] RACK FOR SPORTS EQUIPMENT

[76] Inventor: Gilles Dumont, 47 Bienvenue, St.Constant, Quebec, Canada, J5A 1X5

[21] Appl. No.: 853,783

[22] Filed: May 9, 1997

[51] Int. Cl.[6] ..... A47F 7/00

[52] U.S. Cl. ..... 211/85.7; 211/196; 211/205; 211/118; D6/552

[58] Field of Search ..... 211/85.7, 196, 211/205, 118; D6/552; 248/292.13, 218.4, 219.3, 219.4

[56] References Cited

U.S. PATENT DOCUMENTS

| | | | |
|---|---|---|---|
| D. 353,717 | 12/1994 | O'Neil | D6/552 X |
| 1,292,314 | 1/1919 | Hays | 211/196 X |
| 2,708,324 | 5/1955 | Wedden | 211/196 |
| 3,310,180 | 3/1967 | Neagle | 211/205 |
| 5,377,849 | 1/1995 | Martin | 211/85.7 |
| 5,617,958 | 4/1997 | Laug et al. | 211/85.7 |

*Primary Examiner*—Robert W. Gibson, Jr.
*Attorney, Agent, or Firm*—Eric Finchman

[57] ABSTRACT

There is provided a sports equipment rack which has a central post, a plurality of outwardly extending hanger members to receive an article of clothing or piece of sports equipment, with at least one of the hanger members being moveable between a first storage position wherein the member lies adjacent the central post and a second garment or equipment hanging position wherein the hanger member extends outwardly to receive the piece of clothing or sports equipment. An elasticized member preferably extends around the post and the moveable hanger members to retain the same in a storage position when not wanted. There is also provided a portable sports equipment rack.

8 Claims, 3 Drawing Sheets

RACK FOR SPORTS EQUIPMENT

BACKGROUND OF THE INVENTION

The present invention relates to equipment for the storage of sports accessories and more particularly, relates to a sports equipment rack which may be utilized for sports equipment including articles of clothing.

Some sports and particularly contact sports such as hockey and football utilize a great deal of equipment which must be stored. The equipment can not be stored immediately after use as generally it must be aired and dried. This is also the case even in some non-contact sports such as skiing and the like.

If the equipment and clothing is not properly dried, mold and mildew and unpleasant odors can result.

The use of various types of racks for sports equipment is known in the art. One such sports equipment rack is disclosed in U.S. Pat. No. 5,377,849. In this patent, there is taught a sports equipment rack which may be utilized for supporting different types of sports equipment in a spaced apart relationship. The rack is comprised of various support members which are interconnected together. The patentee teaches that the rack may be transported without disassembly. As shown in FIG. 3 of this patent, a number of different pieces or components are utilized in the assembly of the rack rendering it relatively complex and expensive.

Other devices for the purpose of supporting pieces of sports equipment are shown in Canadian Industrial Design Registrations 355,288, and 354,654. These devices show the use of a central support and fixed arms for the support of sports equipment.

There are also a number of different types of clothes stands or display racks which are designed for displaying equipment and/or clothing. Generally, each one of the display racks is designed for a particular type of clothing and is not adaptable for the drying and airing of sports equipment.

SUMMARY OF THE INVENTION

It is therefore an object of the present invention to provide for a sports equipment rack which is designed to accept different pieces of equipment and/or clothing for the drying thereof.

It is a further object of the present invention to provide a sports equipment rack which is compact and utilizes relatively few components.

It is a further object of the present invention to provide a portable sports rack which may be carried by the athlete while travelling.

According to one aspect of the present invention, there is provided a sports equipment rack comprising a central post, a plurality of outwardly extending hanger members to receive an article of clothing or a piece of sports equipment, at least one of the hanger members being movable between a first storage position wherein the member lies adjacent the central post and a second garment hanging position wherein the hanger member extends outwardly to receive the article of clothing or piece of sports equipment.

In a greater detail, the central post may be any convenient and preferably is a rectangular tubular member. The post and associated members may be formed of any known suitable material including various metals and plastics.

Extending outwardly from the central post are a plurality of hanger members. The particular arrangement of the hanger members can vary depending upon the intended use with one preferred embodiment being shown in the drawings which will be discussed in greater detail hereinbelow.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
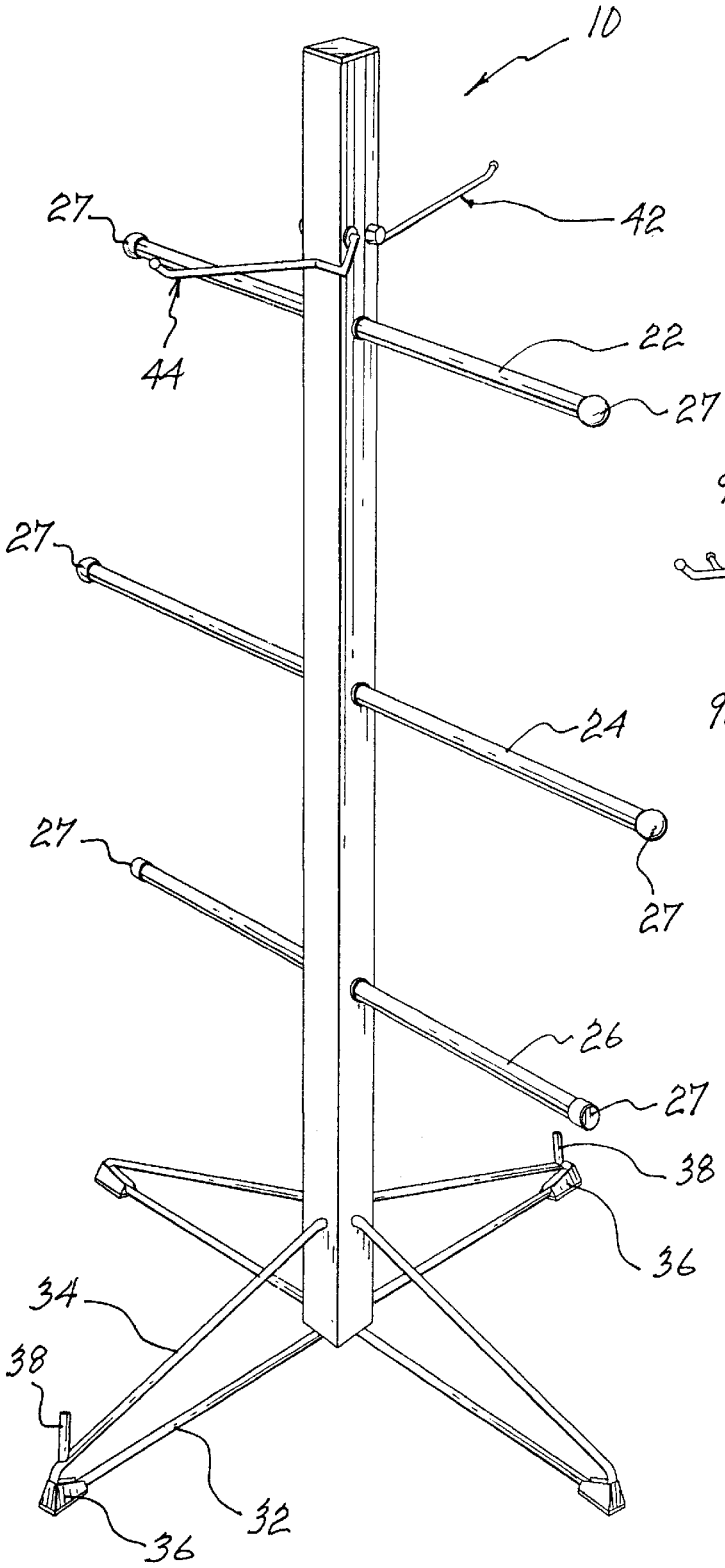
FIG. 1 is a perspective view of a sports equipment rack according to one embodiment of the present invention.
Figure 2:
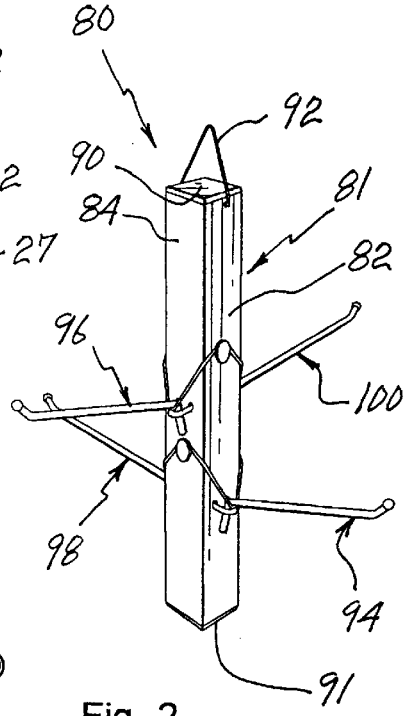
FIG. 2 is a perspective view of a portable sports equipment rack according to a further embodiment of the present invention.

Referring the drawings in greater detail and by reference characters thereto, there is illustrated a sports equipment rack which is generally designated by reference numeral 10.

Sports equipment rack 10 includes a central post 12 which is of a rectangular configuration and has a first pair of opposed sides 14 and 18 and a second pair of opposed sides 16 and 20.

Sports equipment rack 10 further includes equipment support members 22, 24 and 26 which are circular in cross section and which extend through apertures in sides 14, 18 of central post 12. In the illustrated embodiment, equipment support member 24 is of a slightly greater length than equipment support members 22 and 26. It will be understood that different lengths may be employed as desired and that the support members may be moved horizontally from one side to the other. Each equipment support member 22, 24 and 26 carries an end cap 27 at the distal ends thereof.

Central support 12 is held in the vertical position by means of base support elements 28 and 30. Base support element 28 includes a horizontal portion 32 extending substantially normal to sidewalls 16 and 20 of central post 12. At either end, there are provided inwardly angled portions 34 which terminate with an end thereof fitting within apertures within walls 16 and 20 of central post 12. At the outer extremity of horizontal portion 32 there are provided footpads 36. Stop members 38, for reasons which will become apparent hereinbelow, are located on inwardly angled portions 34.

Base support member 30 is of a substantially identical structure to base support member 28 except that it does not have stop members 38 thereon. Base support members 28, 30 are held in position by a screw 31 through horizontal portion 32 to central support 12; this serves to tension base support members 28, 30 which in an unattached position would be slightly spaced therefrom.

Located proximate the upper end of central post 12 are a pair of moveable equipment support members generally designated by reference numerals 42 and 44. Each moveable equipment support member 42, 44 is substantially identical and thus, only one will be described herein.

Figure 5:
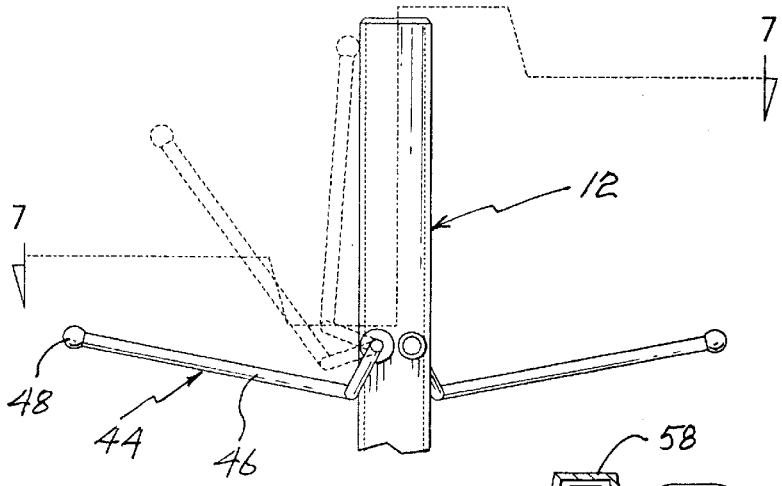
FIG. 5 is a partial side elevational view showing the upper portion of the sports equipment rack of FIG. 1.
Figure 7:
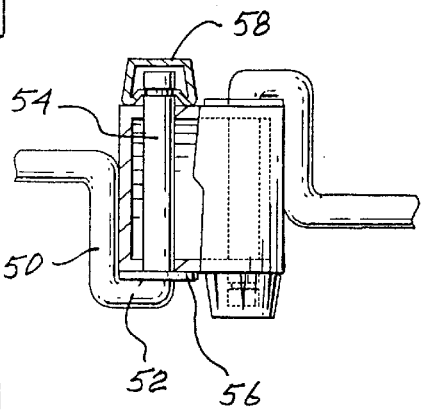
FIG. 7 is a cross-sectional view taken along the lines 7—7 of FIG. 5.
Figure 9:
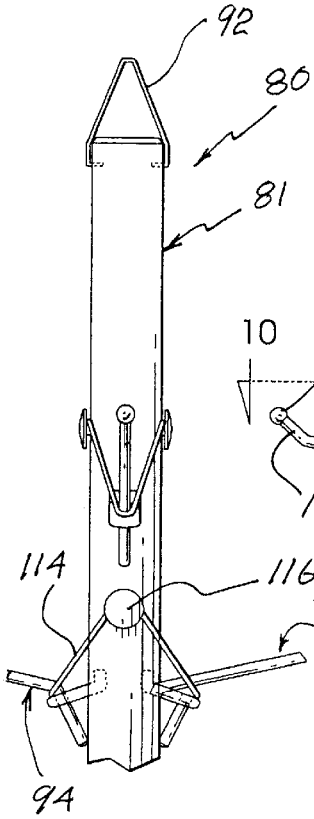
FIG. 9 is a front elevational view of FIG. 8.

Moveable equipment support member 44 includes a longitudinally extending arm 46 having an end cap 48 placed on a distal end thereof. At the end proximate central post 12, longitudinal arm 46 terminates in a first arm segment 50 which extends horizontally and perpendicularly with respect to longitudinal arm 46. In turn, first arm segment 50 merges with a second arm segment 52 and which arm segment 52 in turn terminates in a shaft 54 extending through central post 12. Thus, longitudinal arm 46 may be moved from the position where it extends outwardly for storing equipment to a position wherein it will lie adjacent wall 16 as shown in FIG. 5. Arm segment 50 limits the extent of downward movement of moveable equipment support member 44.

To retain moveable equipment support member 44 in a vertical position, a washer 56 is interposed between arm segment 52 and post 12. A press fit cap 58 on the distal end of shaft 54 in conjunction with washer 56 frictionally retains member 44 in the desired position.

Figure 3:
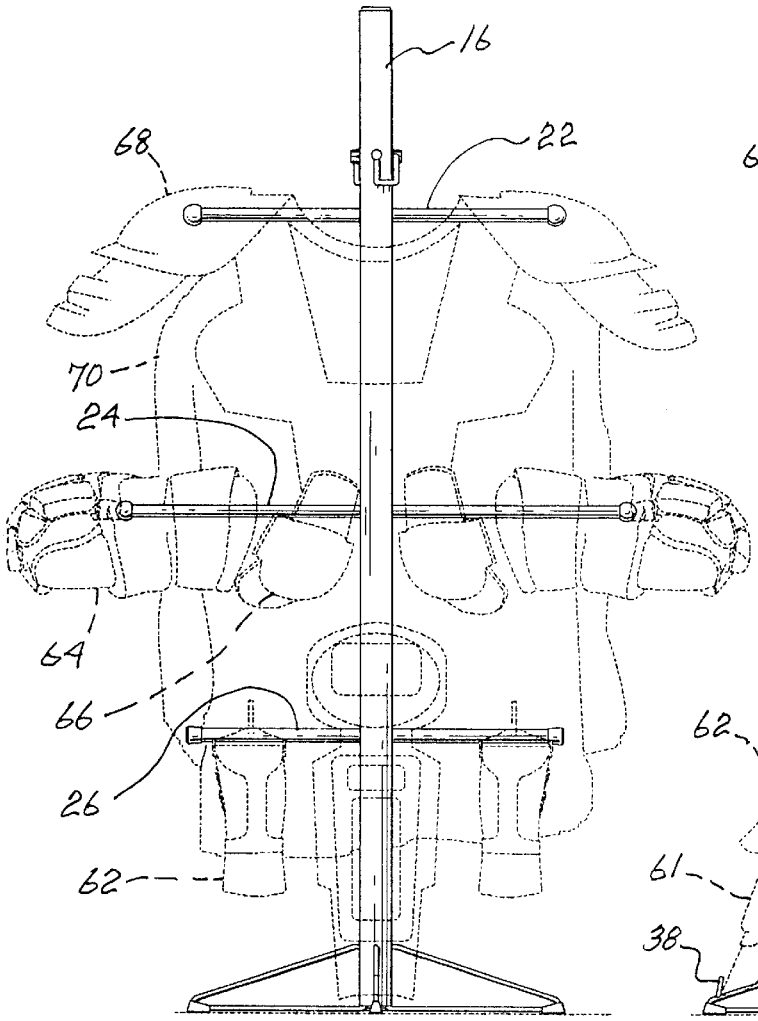
FIG. 3 is a front elevational view of the sports equipment rack of FIG. 1 illustrating placement of sports equipment thereon.
Figure 4:
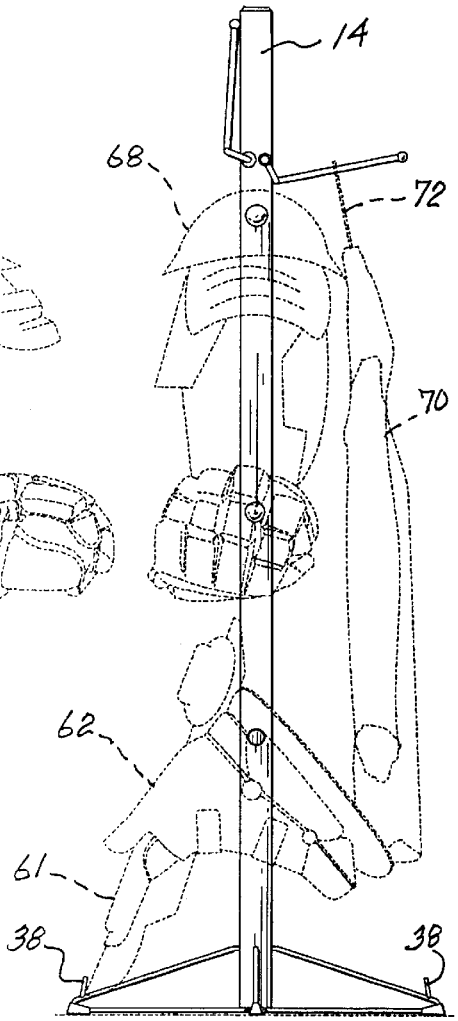
FIG. 4 is a side elevational view of FIG. 3.
Figure 6:
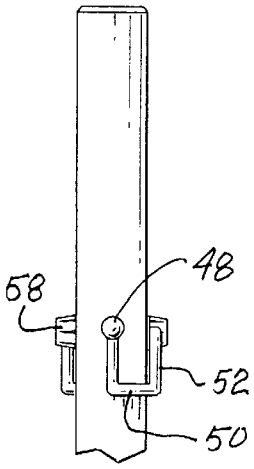
FIG. 6 is a front elevational view of FIG. 5.

In operation, the sports equipment rack may be used for various pieces of sport paraphernalia and one such arrangement is shown in FIGS. 3 and 4 wherein equipment used for ice hockey is illustrated. In this arrangement, skates 62 may be stored on equipment support member 26 while gloves 64 and elbow pads 66 are stored on equipment support member 24. Upper equipment support member 22 is utilized for shoulder pads 68 while a sweater 70 is hung by means of a conventional clothes hanger 72 on moveable equipment support member 44. Stop members 38 support shin pads 61.

A portable sports equipment rack is illustrated in FIGS. 2 and 8 to 10 and will now be referred to.

The portable sports equipment rack is generally designated by reference numeral 80 and includes a central post 81 which is of a rectangular configuration including sides 82, 84, 86 and 88. An end cap 90 is provided at the upper end and a similar end cap 91 at the lower end thereof. A hanger 92 may be provided to hang the rack from a suitable support.

In this particular embodiment, there are provided moveable equipment support members 94, 96, 98 and 100, each being associated with a respective sidewall.

Each of moveable equipment support members 94, 96, 98 and 100 are substantially identical thus only one will be described herein.

Figure 8:
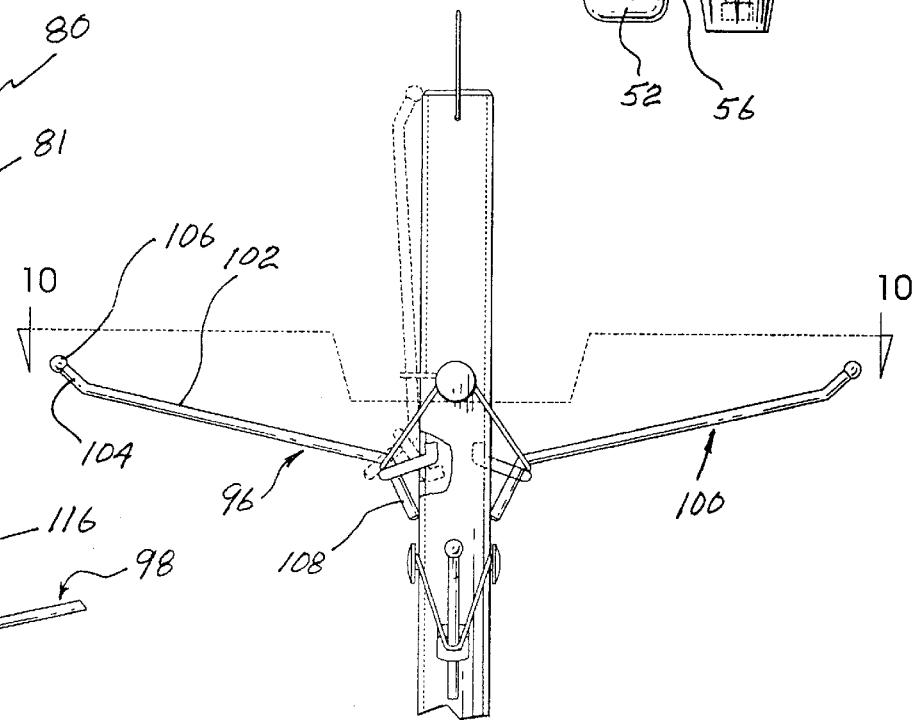
FIG. 8 is a view similar to FIG. 5, but of the second embodiment of FIG. 2.
Figure 10:
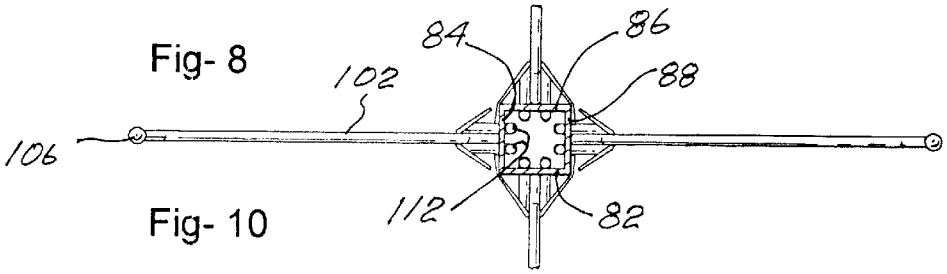
FIG. 10 is a cross-sectional view taken along the lines 10—10 of FIG. 8.

As shown in FIG. 8, moveable equipment support member 96 includes an elongated arm 102 having an angled segment 104 at a distal end thereof. An end cap 106 is mounted on the free end of angled segment 104.

At its other end, elongated arm 102 terminates in a downwardly extending leg 108 and an inwardly extending fork 110. Each of two-fork arms terminate in angled segments 112 fitting within central post 81.

Associated with moveable equipment support members 94 and 98 is an elasticized retaining member 114 which extends around central post 81 and is retained in place by means of a retaining clip 116. In other words, elasticized retaining member 114 functions to retain moveable equipment support members 94 and 98 adjacent central post 116 in a storage position when not required. A similar arrangement prevails for members 96 and 100.

As will be seen, all of the moveable equipment support members 94, 96, 98 and 100 may be moved to a position wherein they lie adjacent the sidewalls of support post 81. As such, they permit the rack 80 to be easily carried in a sports equipment bag and the device may then be used for drying equipment such as in the locker room.

It will be understood that the above described embodiments are for purposes of illustration only and that changes and modifications may be made thereto without departing from the spirit and scope of the invention.

I claim:

1. A sports equipment rack comprising a central post, a plurality of outwardly extending hanger members to receive an article thereon, at least one of the hanger members being moveable between a first storage position wherein the member lies adjacent said central post and a second equipment hanging position wherein the hanger member extends outwardly to receive an article of sports equipment, at least one other of said outwardly extending hanger members comprising a horizontally extending hanger member, said horizontally extending hanger member extending through said central post and being supported thereby.

2. The sports equipment rack of claim 1 further including base support members, said base support members being secured proximate a bottom end of said central post.

3. The sports equipment rack of claim 1 wherein said outwardly extending hanger members include two hanger members being moveable between said first storage position and said second equipment hanging position.

4. The sports equipment rack of claim 3 further including end caps at distal ends of said outwardly extending hanging members.

5. The sports equipment rack of claim 1 further including means to retain said at least one of the moveable hanger members in a position adjacent to said central post.

6. The sports equipment rack of claim 5 wherein said means comprises an elasticized member.

7. The sports equipment rack of claim 2 wherein said base support members each include an outwardly extending stop member to support a piece of sports equipment.

8. The sports equipment rack of claim 1 further including first and second base support members, each of said base support members comprising a horizontal portion and an upwardly and inwardly extending arm at each opposed end of said horizontal portion, a distal end of each of said upwardly and inwardly extending arms being secured to said central post, said horizontal portions being attached to a bottom of said central post.

* * * * *